US007270279B2

(12) United States Patent
Monk

(10) Patent No.: US 7,270,279 B2
(45) Date of Patent: Sep. 18, 2007

(54) PINEWOOD CAR RACING TRACK THAT IS EASY TO ASSEMBLE, DURABLE, AND STURDY

(76) Inventor: Steven Monk, 131 Oakridge Dr., Forest City, IA (US) 50436

( * ) Notice: Subject to any disclaimer, the term of this patent is extended or adjusted under 35 U.S.C. 154(b) by 0 days.

(21) Appl. No.: 10/447,053

(22) Filed: May 27, 2003

(65) Prior Publication Data

US 2004/0238655 A1 Dec. 2, 2004

(51) Int. Cl.
*E01B 23/00* (2006.01)

(52) U.S. Cl. ..... 238/10 F

(58) Field of Classification Search ..... 238/10 R, 238/10 A, 10 B, 10 C, 10 F; 104/53, 60, 104/69

See application file for complete search history.

(56) References Cited

U.S. PATENT DOCUMENTS 3,751,847 A * 8/1973 Neuhierl ..... 446/429
4,241,875 A * 12/1980 Vandenbrink ..... 238/10 F
5,687,649 A * 11/1997 Koeninger et al. ..... 104/106
5,848,743 A * 12/1998 Derecktor ..... 224/331
6,601,774 B1 * 8/2003 Kasimoff ..... 238/10 R
6,647,893 B1 * 11/2003 Fugitt et al. ..... 104/69

OTHER PUBLICATIONS

U.S. Appl. No. 09/887,363, filed Dec. 26, 2002, Delage, Entire Application.

* cited by examiner

*Primary Examiner*—S. Joseph Morano
*Assistant Examiner*—Robert J. McCarry, Jr.
(74) *Attorney, Agent, or Firm*—Gray, Plant, Mooty, Mooty & Bennett, PA; Michael A. Bondi

(57) ABSTRACT

An extruded track for racing small wooden or other material gravity propelled cars like those raced by the Cub Scouts, Awanas and other organizations. The extrusions has a continuous slot on the bottom which allows hex head bolts to be snugly held. This features allows attachments such as the stand starting gate, and other accessories to be easily attached and adjusted with out additional machining, therefore saving on manufacturing costs. The extrusion, also, has a cleared out area on the top of the track to allow extra clearance for weights attached to the bottom of the car. The end extrusion is specially designed to allow for braking of the cars.

13 Claims, 5 Drawing Sheets

PINEWOOD CAR RACING TRACK THAT IS EASY TO ASSEMBLE, DURABLE, AND STURDY

FEDERALLY SPONSORED RESEARCH

Not Applicable

SEQUENCE LISTING OR PROGRAM

Not Applicable

BACKGROUND

1. Field of Invention

This invention relates to a pine car derby track, specifically, an improved pinewood derby track that is durable, sturdy, and easily assembled. The pinewood derby races are generally a youth activity commonly associated with the Cub Scouts or church groups. The race consists of running wood cars typically weighing five ounces powered by gravity down a track of 2 to 8 lanes and 32 to 50 feet in length. The cars are made by carving a block of wood into the shape of a car and using four nails as axles to attach the wheels.

2. Description of Prior Art

The pinewood derby races are generally a youth activity commonly associated with the Cub Scouts or church groups. The race consists of running wood cars typically weighing five ounces powered by gravity down a track of 2 to 8 lanes and 32 to 50 feet in length. The cars are made by carving a block of wood into the shape of a car and using four nails as axles to attach the wheels. Further, it is quite common for the cars to have weights attached to the bottom so that cars weigh as close to five ounces as possible.

The original track design which dates to the early 1950's uses a 4' by 8' sheet of plywood, cut into 4 lengths about 1 foot wide, joined end to end and further provided with lath strips in the center of each lane which act as car guides. A stand is provided at the start to create a "hill". The lath is lifted after the finish line and the track is covered with carpet to stop the cars.

Hereto the only known patent or patent application is U.S. patent application Ser. No. 09/887,363 to Delage (2001) and published on Dec. 26, 2002, this patent application does an excellent job describing the websites that currently offer pinewood derby tracks for sale and description on how to make such tracks. This patent describes a pinewood derby track that is made of aluminum or other material and overcomes many of the problems associated with wood or other aluminum.

Delage Patent Application lists several disadvantages associated with the original track and the known modifications to this design. (1) The track is heavy typically 60 pounds for a three-lane track of 15 pounds per 8-foot section. (2) The wood track is prone to splintering and warping. Thus, requiring lots of painting and maintenance especially at the joints. (3) Assembly, especially of the joints, requires lots of small, easily lost, parts as well as tools. The screws and nuts protrude below the track gouging the floor. (4) Construction is typically difficult requiring a craftsman. (5) The method of using a center lath causes the cars to rub and lose speed. (6) The braking of the cars is ineffective. (7) The starting mechanism is ineffective.

Delage Patent Application stated goals are to drastically reduce the weight, eliminate maintenance, eliminate splinters, eliminate warping, provide a smooth and consistent race surface aligned in all planes. Delage application uses a plastic track in attempt to accomplish these goals. The problems with a plastic track are that they still warp over time, they discolor over time, and when assembled tend to be flimsy and tend to break apart. Delage application method of alignment requires that two long extrusion be held together by a third shorter extrusion that is held together by a rubber band. This method again tends to be flimsy and requires additional track and machining of various lengths of tracks. The flimsy nature of the track still prevents the desired goal of a track that is well aligned. Further, the design of the Delage track does nothing to prevent cars that have weights attached to the bottoms from dragging.

SUMMARY OF THE INVENTION

The present invention is designed to provide a compromise between ease of assembly, durable, and sturdy track. In the present invention, a track made from either aluminum or other material extrusion is described. Using the present invention a track of any width and length can easily be assemble to provide a sturdy and durable racing surface.

More particularly, the extrusion is designed with slots on the bottom to allow for the attachment of joiner angles, a stand, a starting mechanisms and any other device by simply sliding a the head of hex head or other bolt into the slot. Track alignment is accomplished by using alignment pins for the end-to-end pieces of track and a tongue and groove system for the side-to-side pieces of track. The track is cleared out on the top to allow extra clearance for any weights that might be attached to the bottom of the car. The present invention further describes an improved means of stopping the car with a lowered wheel track area and a rubber surface.

These and other advantages and novel features of the present invention, as well as details of an illustrated embodiment thereof, will be more fully understood from the following description and drawings.

BRIEF DESCRIPTION OF THE DRAWINGS

Drawing Figures

DETAILED DESCRIPTION OF THE PREFERRED EMBODIMENT

Figure 1:
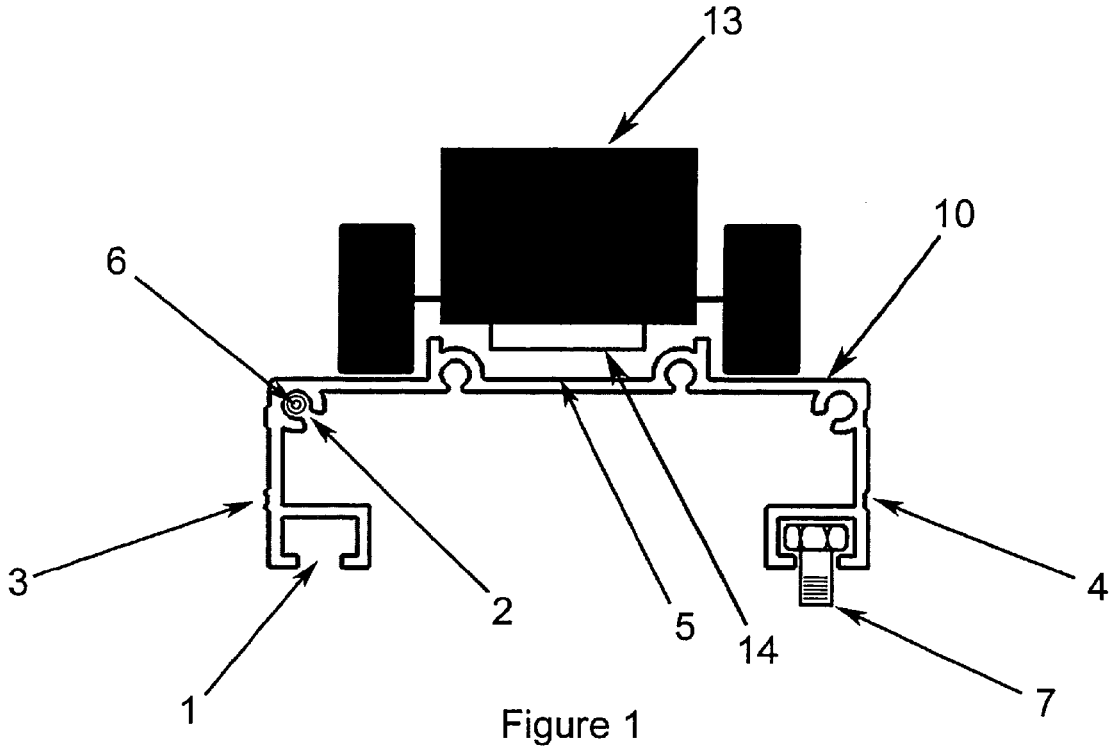
FIG. 1 illustrates a end view of the preferred extrusion of the present invention.
Figure 3:
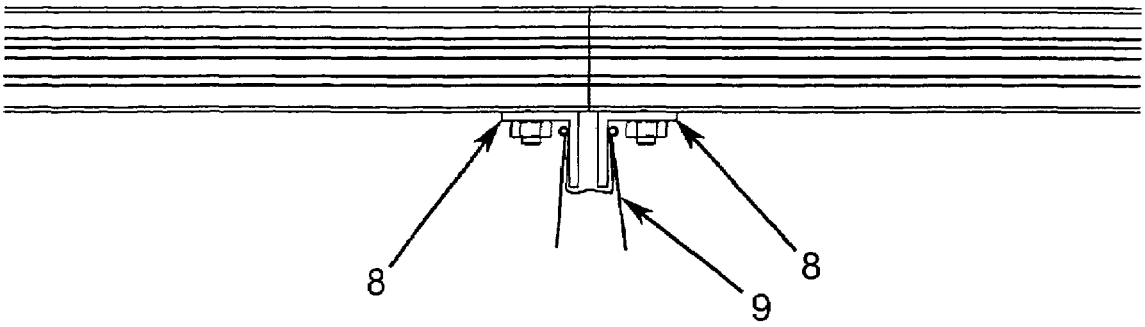
FIG. 3 illustrates how the extrusions are joined together.

FIG. 1 shows the major advantage of this invention a continuous slot 1 on the bottom of an aluminum extrusion. This continuous slot 1 is manufactured so that a hex head bolt 7 fits snugly in the preferred embodiment a ¼" bolt is used. The snug fitting design of the hex nut greatly aids in the assembling of the track as it acts as a wrench when tighten a nut to the bolt. The continuous slot 1 and hex head bolts 7 system is used to attach and adjust various accessories. In addition to attaching variety accessories, the continuous slot 1 and hex head bolts 7 system is used to attach connector angles 8, see FIG. 3. The connector angles 8 are used to help provide a ridge and stable track as well as keeping the track together during the course of the race. This function is accomplished by clipping together two connector angles 8 with a spring clip 9, see FIG. 3.

Figure 2A:
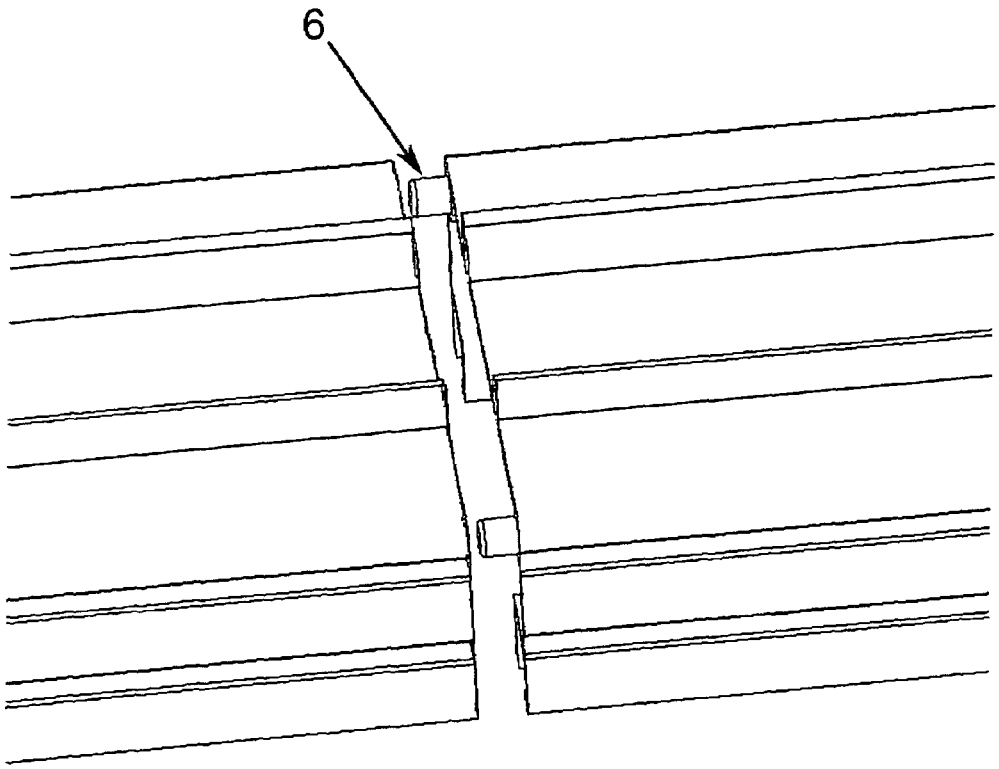
FIG. 2A illustrates how the extrusions are aligned end-to-end.
Figure 2B:
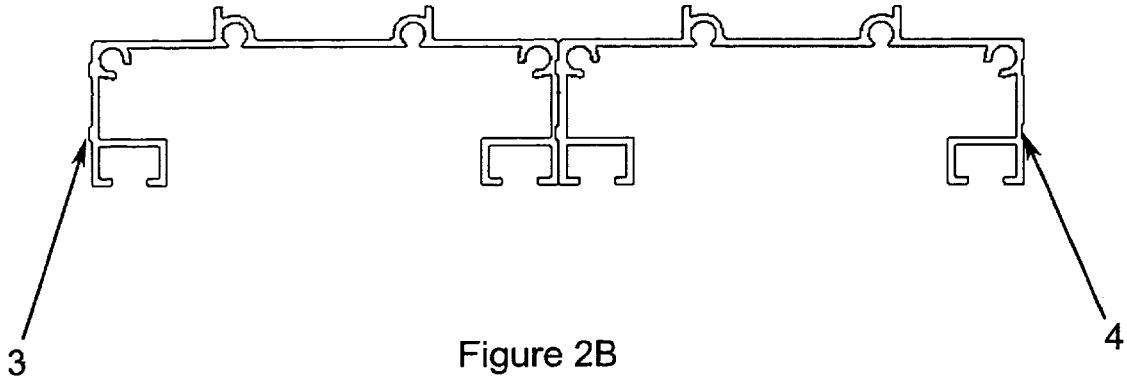
FIG. 2B illustrates how the extrusions are aligned side-to-side.

The two methods by which the extrusions are aligned provide additional stability and durability to the track. FIG. 2A shows how the track is aligned end-to-end. FIG. 1 shows a pin hole 2 on either side of the extrusion in the preferred embodiment a 3/16" pin hole is used. Two extrusions are aligned by gently tapping a 3/16" serrated pin 6, see FIG. 1, into pin holes 2 on one of the extrusion until only approximately 3/16" of the serrated pin 6 extends from the extrusion, see FIG. 2A. The other extrusion is then gently tapped onto the protruding serrated pin 6, see FIG. 2A. The process is repeated until the desire length and shape of the track is accomplished. The number of lanes is accomplished by a different alignment method that is a tongue and groove type system shown in FIG. 2B. FIG. 1 shows the alignment bump 3 and the alignment cavity 4. The alignment bump 3 fits snugly into the alignment cavity 4 to ensure a perfect alignment, see FIG. 2B. Both of the end-to-end and side-to-side alignment systems are further reinforced by the connector angles 8 and spring clip 9 system described in the paragraph above.

FIG. 1 shows a clear out area 5 on the top part of the track. This clear out area 5 is an important feature of the track because it allows clearance between the track and the bottom of the car 13. This clearance is particularly important because the heavier the car the faster the car runs. Therefore, participates try to get the cars as close to 5 ounces as possible by adding weights 14 to the bottom of the car 13, see FIG. 1.

Figure 4:
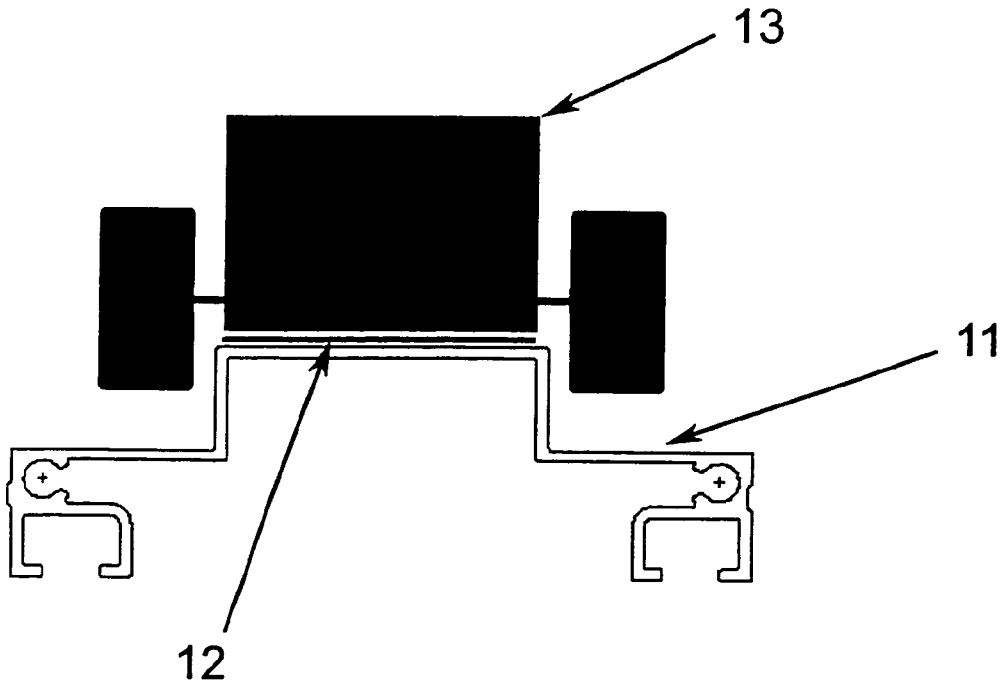
FIG. 4 illustrates a preferred extrusion profile for braking.

Another important aspect of this track is the unique braking extrusion, see FIG. 4. The extrusion has a lower wheel track area 11 as compared to the normal extrusion wheel track area 10, see FIG. 4 and FIG. 1 respectively. The lower wheel track causes the underside of the car to make contact with the track. The braking extrusion has a 1/16" thick skid resistant foam rubber tape 12 attached to the center of the track. As the car bottoms out on the foam rubber tape 12 it slows slides to a safe stop without damaging the car.

In the preferred embodiment aluminum is used however other material maybe used with out departing from the spirit and scope of the present invention. In view of the above detailed description of the present invention and associated drawings, other modifications and variations will now become apparent to those skilled in the art. It should be apparent that such other modifications and variations may be effected without departing from the spirit and scope of the present invention.

I claim:

1. A wood car track made by extrusion with slots on the bottom of the extruded track sections to allow for joining the extruded track by using said slot and a first connector bolt and connector angle, and for attaching accessories to said track using a second connector bolt to said slot where the slot is sized to fit the head of a hex head bolt not allowing it to rotate; and an end extrusion modified to stop the car by lowering the wheel track area and said top of the end extrusion is covered with a rubber surface.

2. A wood car track made by extrusion with slots on the bottom of the extruded track sections to allow for joining the extruded track by using said slot and a first connector bolt and connector angle, and for attaching accessories to said track using a second connector bolt to said slot where the slot is sized to fit the head of a hex head bolt not allowing it to rotate; and said extrusions aligned end-to-end by using pin holes and serrated pins; said extrusions aligned side-to-side by using alignment bumps and alignment cavities; the center of the track being cleared out to allow clearance for a weighted car; and one of the extrusions modified to stop the car by lowering the wheel track and said top of the extrusion is covered with a rubber surface.

3. A gravity powered wood car track made by extrusion with slots on the bottom track sections to allow for joining the resulting extruded track sections by using said slot and a connector bolt and connector angle where spring clips are used to hold tension on the end joints created by bolting the lanes sections to the connector angle and where the extruded track sections are aligned end-to-end by using pin holes and serrated pins; the extruded track sections are aligned side-to-side by using alignment bumps and alignment cavities; the center of the track is cleared out to allow clearance for a weighted car; one of the extruded track section is modified to stop the car by lowering the wheel track area and top of the extruded track section is covered with a rubber surface; and using connector bolt and the slot on the bottom of the track to attach accessories to the track.

4. A gravity powered wood car track comprising:

a weighted gravity powered wood car having a main body and a plurality of wheels;

a plurality of gravity powered wood car track sections;

said gravity powered wood car supported on the gravity powered wood car track sections, wherein said track sections are extruded and wherein the extrusions are aligned side-to-side by using alignment bumps and alignment cavities; and a braking section attached to at least one of the track sections, wherein the braking section has a rubber surface that contacts the car main body when the gravity powered car is on the braking section.

5. The gravity powered wood car track of claim 4 wherein:

said track sections are extruded and wherein said extrusions are aligned end-to-end by using pin holes which were extruded as part of the extrusion, and serrated pins.

6. The gravity powered wood car track of claim 4 wherein:

said track sections are extruded and wherein the extrusions are aligned end-to-end by using pin holes and serrated pins and the extrusions are further aligned side-by-side by using alignment bumps and alignment cavities.

7. A wood car track comprised of track sections with slots on the bottom of the track sections to allow for joining the track sections by using a slot and a first connector bolt and connector angle, and for attaching accessories to said track sections using a second connector bolt to a slot where the slot is sized to fit the head of a hex head bolt not allowing it to rotate; and an end section modified to stop the car by lowering the wheel track area.

8. A wood car track comprised of track sections with slots on the bottom of the track sections to allow for joining the track sections by using a slot and a first connector bolt and connector angle, and for attaching accessories to said track using a second connector bolt to said slot where the slot is sized to fit the head of a hex head bolt not allowing it to rotate; and said track sections aligned end-to-end by using pin holes and serrated pins; said track sections aligned side-to-side by using alignment bumps and alignment cavities; the center of the track being cleared out to allow clearance for a weighted car; and one of the track sections modified to stop the car by lowering the wheel track and said top said one section is covered with a rubber surface.

9. A gravity powered wood car track comprised of track sections with slots on the bottom of the track sections to allow for joining the track sections by using said slots and a connector bolt and connector angle where spring clips are used to hold tension on the end joints created by bolting the sections to the connector angle and where the track sections are aligned end-to-end by using pin holes and serrated pins; the track sections are aligned side-to-side by using alignment bumps and alignment cavities; the center of the track is cleared out to allow clearance for a weighted car; one track section modified to stop the car by lowering the wheel track area and top of the extruded track section is covered with a rubber surface; and using connector bolt and the slot on the bottom of the track to attach accessories to the track.

10. A car track for use with a gravity powered car, wherein the gravity powered car has a main body to which a plurality of wheels are attached, the car track comprising:

an elongated main section; and a braking section attached to the main section, wherein the braking section has a central area and a lower wheel track area on at least one side of the central area, wherein the lower wheel track area is located beneath the central area so that the plurality of wheels do not touch the lower wheel track area when the gravity powered car is placed so that car main body is on the central area.

11. The car track of claim 10, and further comprising a skid resistant surface applied to the central area.

12. The car track of claim 10, wherein the skid resistant surface is fabricated from foam rubber.

13. The car track of claim 10, wherein the central area has a width that is approximately the same as a width of the car main body.

* * * * *